US006209340B1

(12) United States Patent
Lu

(10) Patent No.: US 6,209,340 B1
(45) Date of Patent: Apr. 3, 2001

(54) ICE CLEARING STRUCTURE FOR ICE MAKERS

(75) Inventor: Qiao Lu, Louisville, KY (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/456,976

(22) Filed: Dec. 7, 1999

Related U.S. Application Data

(60) Provisional application No. 60/111,163, filed on Dec. 7, 1998.

(51) Int. Cl.[7] ..... F25C 1/12
(52) U.S. Cl. ..... 62/347
(58) Field of Search ..... 62/73, 74, 347, 62/348, 352

(56) References Cited

U.S. PATENT DOCUMENTS 3,913,349 * 10/1975 Johnson ..... 62/348
4,107,943 * 8/1978 Ohling ..... 62/347
4,366,679 * 1/1983 Van Steenburgh, Jr. ..... 62/352
4,452,049 * 6/1984 Nelson ..... 62/352
4,823,559 * 4/1989 Hagen ..... 62/347
6,122,927 * 9/2000 Moore ..... 62/347

* cited by examiner

*Primary Examiner*—William E. Tapolcai
(74) *Attorney, Agent, or Firm*—Sten Erik Hakanson

(57) ABSTRACT

A modified water drain pan for use in an ice maker is positioned below a vertically oriented evaporator and includes a front lip for receiving run off water from the evaporator during an ice making cycle. The lip includes a plurality of spaced apart ice removing structures defining a V-shaped groove there along. The V-shaped groove is defined by a plurality of front and rear angled surfaces. In operation, when the ice is harvested, the ice sheet falls from the evaporator such that a bottom edge thereof lands within the V-shaped groove. The bottom edge of the ice sheet contacts a front surface of the V-shaped groove wherein the force applied there against by the weight of the entire sheet causes the sheet to rotate about an imaginary axis extending within and along that groove. As a result thereof, the top of the ice sheet tips in a forward direction away from the evaporator where upon it falls into an ice bin there below.

1 Claim, 3 Drawing Sheets

ICE CLEARING STRUCTURE FOR ICE MAKERS

This application claims benefit of Provisional Ser. No. 60/111,163, filed Dec. 7, 1998.

BACKGROUND OF THE INVENTION

1. Field of the Invention

The present invention relates generally to ice makers and more specifically to structures therein for clearing ice from the evaporator.

2. Background

Ice makers are well known in the art and typically make ice by flowing water over an electrically cooled evaporator. The water that is not frozen onto the evaporator is caught by a drain pan and recycled over the evaporator. When an ice sheet of a sufficient thickness has formed thereon, a hot gas defrost cycle is started causing the ice to melt partially around the exterior surface thereof whereupon its adhesion to the evaporator surface is lessened. The ice can then fall from the evaporator and into an ice bin positioned there below. However, a problem can occur where the ice sheet does not fall completely out of the evaporator or contacts and rests on the water drain pan and leans against the evaporator. Subsequent ice making cycles can result in an unwanted build up of ice on the evaporator and shut down of the ice maker.

Various strategies have been employed to insure that the ice sheet is fully and positively removed from the evaporator. A separate active mechanism is known to push the ice from the evaporator. However, such an approach adds further components resulting in an increased cost and a decreased reliability. The evaporator can also be maintained at an angle that is more conducive to the ice falling, i.e. at an angle between the vertical and the horizontal. However, such an angular positioning can result in an undesirable portion of internal ice maker volume being dedicated to the evaporator rather than ice storage and can negatively impact uniform cube formation. Accordingly, it would very desirable to have an ice removing structure that does not increase cost or complexity and that is space efficient.

SUMMARY OF THE INVENTION

The present invention concerns a modified water drain pan for use in an ice maker. The drain pan is positioned below a vertically oriented evaporator and includes a front lip for receiving run off water from the evaporator during the ice making cycle. A plurality of spaced apart ice removing projections are formed integrally into and extend upward from and along the drain pan front lip. The ice moving projections serve to define a V-shaped groove along and adjacent the front lip.

In operation, the drain pan of the present invention is positioned to receive the drain water during the ice making cycle as it flows over the evaporator. When the ice is harvested the ice sheet falls from the evaporator such that a bottom edge thereof lands within the V-shaped groove. A bottom exterior corner edge of the ice sheet contacts a front surface of the V-shaped groove wherein the force applied there against by the weight of the entire sheet causes the sheet to rotate about an imaginary axis extending within and along that groove. As a result thereof, the top of the ice sheet tips in a forward direction away from the evaporator where upon it falls into the ice bin below. Thus, the V-shaped groove causes a movement of the ice sheet powered by its own weight wherein it is moved positively away from the evaporator. Thus, the drain pan of the present invention prevents the ice sheet from being able to rest thereon and lean against the evaporator.

DESCRIPTION OF THE DRAWINGS

A better understanding of the structure and features of the present invention and of the operation and objects and advantages thereof can be had by reference to the following detailed description which refers to the following figures, wherein.

DETAILED DESCRIPTION OF THE PREFERRED EMBODIMENT

Figure 3:
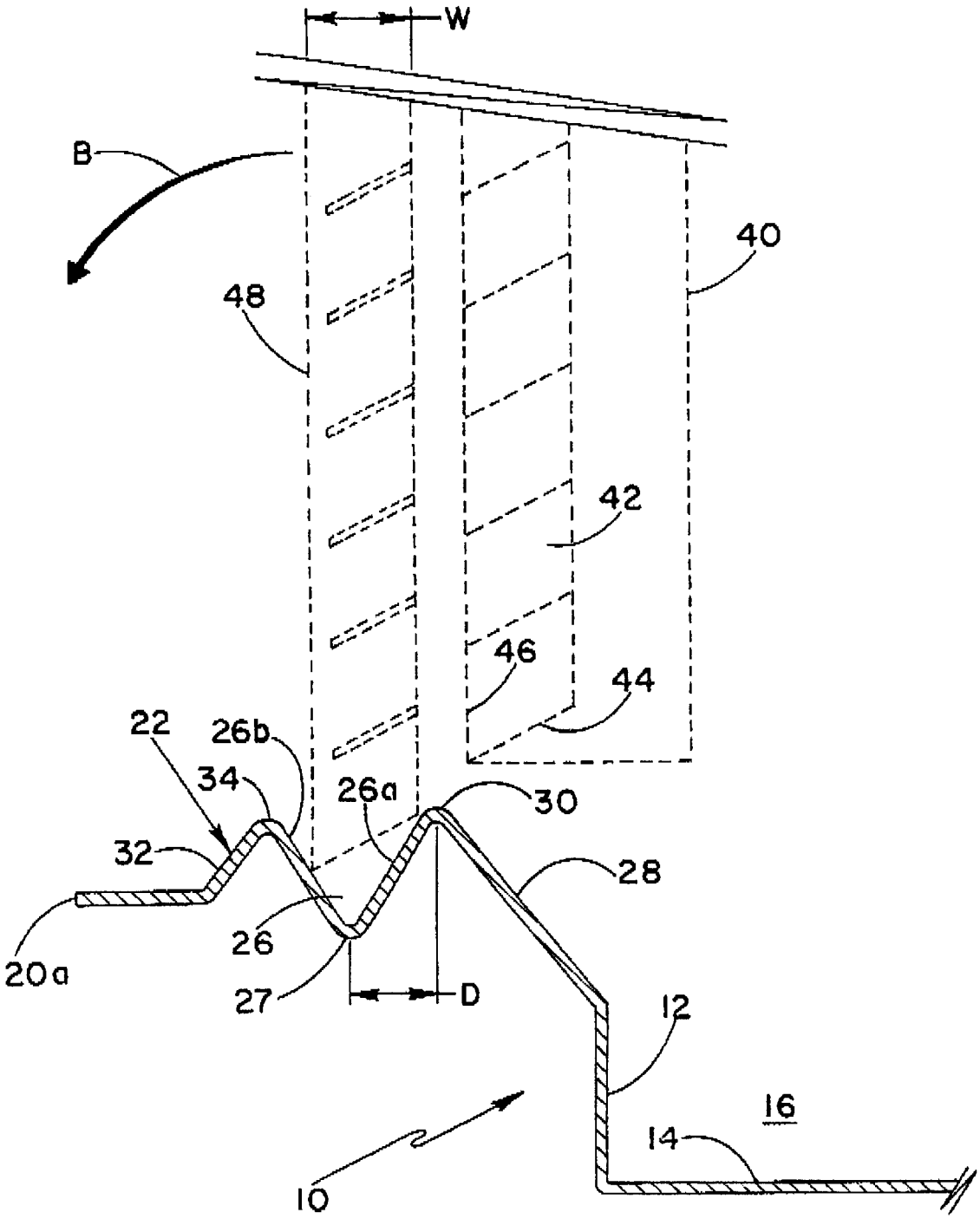
FIG. 3 shows a cross-sectional view along lines 3—3 of FIG. 1.

The drain pan of the present invention is seen in the various figures and generally indicated by the numeral 10. Drain pan 10 includes sidewalls 12 and a bottom surface 14 defining and interior water reservoir volume 16. Bottom surface 14 includes a drain orifice 18. Drain pan 10 also includes a perimeter horizontal edge flange 20 having a front portion 20*a*. A plurality of ice moving structures 22 are integral with and extend upward and from drain pan 10 along front edge 20*a*. Those of skill will understand that pan 10 is formed from a sheet of plastic such as through a vacuum molding process. Thus, as seen in FIG. 3, it will be understood that structures 22 are hollow and formed essentially from or into pan 10. Structures 22 define a V-shaped groove 26 having a bottom point 27 at the junction of a first angular surface 26*a* and a second angular surface 26*b*. Structures 22 also include a third angular surface 28 that together with surface 26*a* define an apex point 30. Fourth angular surfaces 32 define with angular surfaces 26*b* second minor apex points 34. Structures 22 also include vertical sidewalls 36 on either side thereof. Angled water flow surfaces 38 extend between structures 22.

Figure 1:
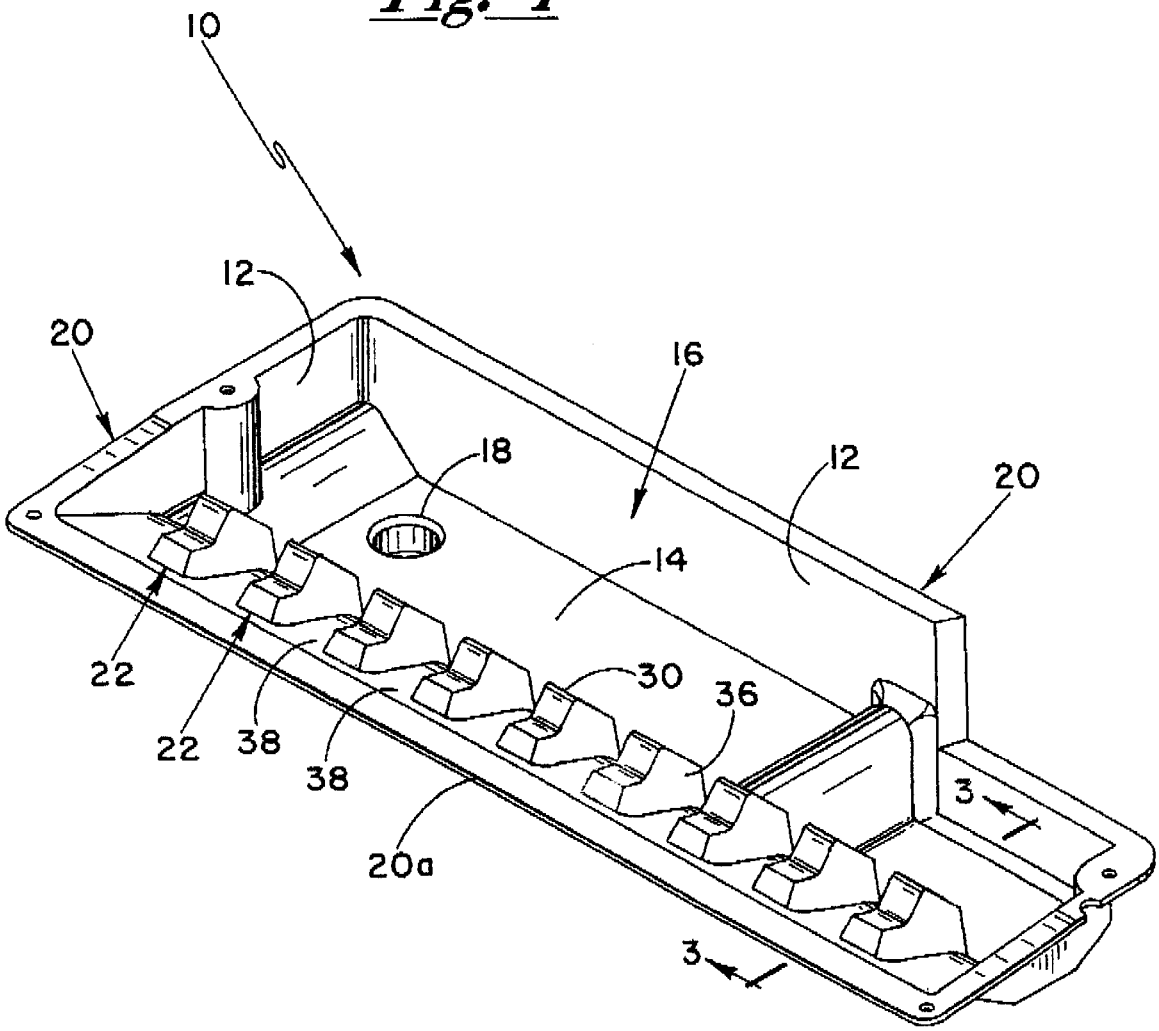
FIG. 1 shows a perspective view of the drain pan of the present invention.
Figure 2:
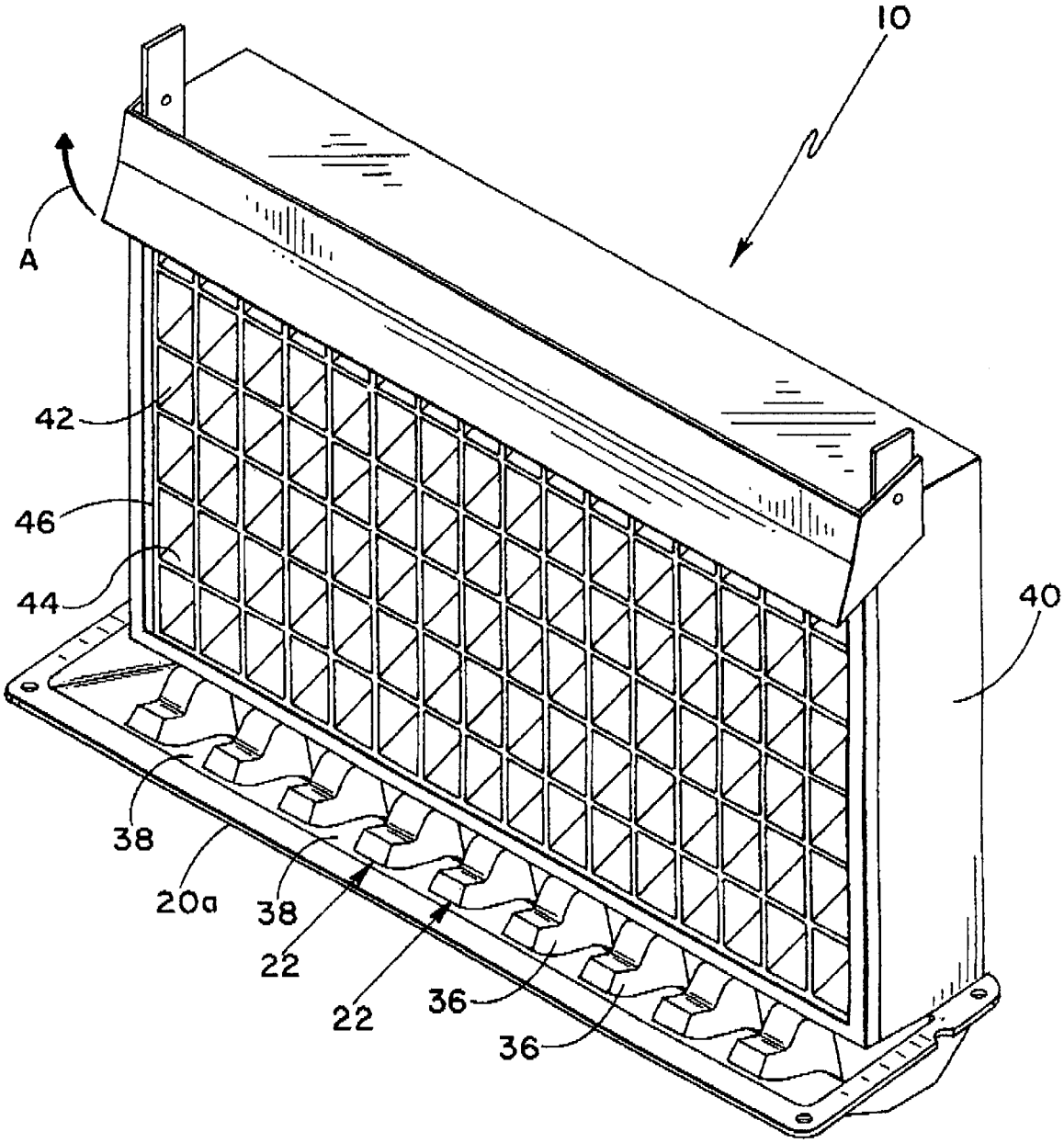
FIG. 2 shows a perspective view of the present invention as positioned within an ice maker below an evaporator.

As seen in FIG. 2, drain pan 10 is positioned below an evaporator 40. Evaporator 40, as is known in the art, includes a plurality of ice forming pockets 42 defined by horizontal dividers 44 and vertical dividers 46. As is also known, horizontal dividers 44 are angled in a downward direction to facilitate the falling of the ice sheet from evaporator 40. An ice harvest bar 47, as is known in the art, is pivotally secured to evaporator 40 for opening into an open position by movement in the direction of arrow A. As is understood, harvest bar 47 opens by the ice sheet falling therefrom. Harvest bar 47 operates a switch, not shown, that indicates such ice sheet movement so that a subsequent ice making cycle can be started. As is well known in the art, the ice sheet is formed in evaporator 40 by a flow of water over the surface thereof. The water originates from a water distribution tube, not shown, located at the top of evaporator 40 and proceeds over the surface as evaporator 40 is cooled by a refrigeration system. Thus, water that is not frozen flows off evaporator 40 and is caught by edge 20*a* of drain pan 10 to flow along surfaces 38 into water reservoir area 16. Water is then pumped from reservoir 16 back over evaporator 40 until a sheet of ice of sufficient thickness has formed thereon. The various refrigeration and water pumping and distribution components and control systems and structures necessary to carry out the above described ice formation process are very well understood, and are not shown herein to facilitate a clear understanding and view of the present invention.

The positive ice clearing operation of the present invention can be understood by reference to FIG. 3 where an ice sheet 48 is shown in dashed outline. Ice sheet 48 first slides under the force of gravity from evaporator 40 after it has been loosened therefrom by, for example, a hot gas defrost cycle. A bottom end 50 of sheet 48 can then be understood to fall into V-shaped groove 26. In particular, angled surface 26*a* can be contacted by end 50 thereby directing end 50 into angled surface 26*b*. Contact between a forward edge 52 and surface 26*b* will cause sheet 48 to rotate about an axis extending along groove 26 resulting in the movement of the top end 54 thereof as indicated by arrow B. As a result thereof, sheet 48 falls into an ice receiving bin located below pan 10. It is important to insure such rotation that the distance D between apex point 30 and bottom point 27 be less than the width W of Sheet 48.

What is claimed is:

1. A drain pan for insuring clearing of a sheet of ice from an evaporator of an ice making machine, the drain pan, comprising:

a plurality of side walls and a bottom surface defining a water retaining volume, a front water receiving lip extending along a front edge thereof, the lip defining a groove there along having a first angled surface and the groove sized with respect to a width of an ice sheet formed on the evaporator so that falling of an ice sheet into the groove results in a top end of the ice sheet moving away from the evaporator so that the ice sheet falls into an ice bin positioned below the drain pan.

* * * * *